US006774297B1

(12) United States Patent
Lee

(10) Patent No.: US 6,774,297 B1
(45) **Date of Patent: *Aug. 10, 2004**

(54) SYSTEM FOR STORING AND ORCHESTRATING DIGITIZED MUSIC

(75) Inventor: J. Robert Lee, San Diego, CA (US)

(73) Assignee: QRS Music Technologies, Inc., Naples, FL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 1826 days.

(21) Appl. No.: 08/377,027

(22) Filed: Jan. 19, 1995

(51) Int. Cl.[7] ..... A63H 5/00; G10H 7/00; G04B 13/00

(52) U.S. Cl. ..... 84/609; 84/602; 84/610; 84/615

(58) Field of Search ..... 84/602–606, 609–610, 84/615, 617, 619, 622, 625

(56) References Cited

U.S. PATENT DOCUMENTS 4,468,998 A * 9/1984 Baggie ..... 84/1.03
5,155,286 A * 10/1992 Saito et al. ..... 84/611
5,286,912 A * 2/1994 Yamaguchi ..... 84/616
5,355,762 A * 10/1994 Tabata ..... 84/609
5,430,242 A * 7/1995 Morita ..... 84/609
5,496,178 A * 3/1996 Back ..... 434/307 A

OTHER PUBLICATIONS

Audiotape: Tutorial created by J. Robert Lee, Sep. 8, 1998.

* cited by examiner

*Primary Examiner*—Marlon T. Fletcher
(74) *Attorney, Agent, or Firm*—Barnes & Thornburg LLP

(57) ABSTRACT

A computer-based music synthesizer system includes a data storage medium for electronically storing a multiplicity of four-part hymns. The user of the system may select the hymn to be played, and may also cause the system to automatically generate an appropriate plagal cadence to establish an "amen" phrase at the end of the hymn. Each of the four parts of the hymn may be independently orchestrated by the user. Alternatively, the user may select one of a plurality of pre-stored orchestration schemes to cause each part of the hymn to have a predetermined orchestration which may be different from the orchestration of the other parts.

21 Claims, 7 Drawing Sheets

SYSTEM FOR STORING AND ORCHESTRATING DIGITIZED MUSIC

FIELD OF THE INVENTION

The present invention relates generally to digital music synthesizers, and more particularly to synthesizers for playing prerecorded hymns.

BACKGROUND

Electronic music synthesizer devices have been introduced for playing musical tunes and musical accompaniment by transforming digitized data, which is representative of the tune or accompaniment to be played, into corresponding sounds. Essentially, the tunes are first digitized through one of a variety of methods and then played back upon command by the synthesizer device. The playback may be immediate, so that a user can operate, e.g., an electronic keyboard to produce music electronically, or the playback may be delayed, i.e., data representing the digitized music can be stored on a recording medium for playback at some time after recording.

The present invention is directed principally to a synthesizer system wherein digitized music is stored and played back by the system upon user command. Among other advantages, music synthesizer playback systems permit music notes to be represented in discrete digitized data structures that can be stored in physically small locations. One consequence is that the digitized data can be easily modified and played back in a variety of styles, without the need to retain live musicians. For example, the synthesizer can selectively simulate a wide variety of musical instruments, and the tune can be played by the synthesizer to sound as if it were played by a live musician in any desired key and at any desired tempo using a violin, or an organ, or a wind instrument, and so on. Another advantage is that any one of a large number of stored tunes can be retrieved very quickly from the data base with little or no waiting period between tunes.

Typically, synthesizer systems which play digitally prerecorded tunes provide a means for selecting the particular tune desired from a list of recorded tunes. Further, as alluded to above, some synthesizer systems provide a means for establishing a particular orchestration style in which the desired tune is to be played. For purposes of the present invention, the orchestration of a synthesized tune refers to the number and types of simulated instruments produced by the synthesizer system to generate the audible tune.

Although some synthesizer systems permit the user to establish an orchestration for a tune, it is the case that the selected orchestration is imposed on the entire tune. As recognized by the present invention, however, it is frequently desirable to provide for orchestrating each part of the tune independent of the other parts. For purposes of the present invention, a "part" of a tune refers to a sequence of notes that is played or performed simultaneously with one or more other note sequences, i.e., "parts", such that the parts of a tune are harmonized together.

The capability to orchestrate a tune part-by-part is particularly desirable in the case of a certain genre of tunes known as hymns. Typically, hymns are written in four-part harmony, and consequently lend themselves to orchestration of each part on its own. The four parts of a hymn are soprano (also referred to in certain applications as "melody"), alto (referred to in certain applications as "accompaniment "1""), tenor (referred to in certain applications as "accompaniment "2""), and bass (referred to in certain applications as "contra").

As further recognized by the present invention, allowing the user to define the orchestration of a hymn (or to select from several predefined part-by-part orchestrations) adds a great deal of variety to the way a hymn can be played, without the data storage capacity problems that would attend a system in which each hymn was recorded multiple times using a multiple number of predefined orchestrations.

Additionally, hymns are distinguishable from other genre of tunes because they often include an "amen" phrase at the end of the last verse of a hymn. An "amen" phrase is a plagal cadence, keyed to the subdominant and tonic of the hymn, to which the word "amen" is sung. As recognized by the present invention, it would be desirable to provide the user with a simple means for causing an appropriately keyed "amen" phrase to be played at the end of the last verse of a hymn.

Accordingly, it is an object of the present invention to provide a synthesizer device which can selectively play any one of a number of digitally stored tunes. Another object of the present invention is to provide a synthesizer device which permits the user to selectively establish the orchestration of each part of a multi-part tune. Still another object of the present invention is to provide a digital hymnal which automatically generates a plagal cadence at the end of a hymn in response to a user-generated command. Yet another object of the present invention is to provide a digital hymnal which is easy to use and cost-effective to manufacture.

SUMMARY OF THE INVENTION

A music synthesizer device for playing at least one prestored tune which is characterized by at least first and second simultaneously-played parts includes a data storage medium. The data storage medium stores a first digital data series representative of the first part of the tune and a second digital data series representative of the second part of the tune.

Additionally, a manipulable input surface is provided for generating an orchestration signal in response to manipulation of the input surface by a user, and an orchestrator receives the orchestration signal. In response, the orchestrator establishes a first orchestration attribute for the first part and a second orchestration attribute for the second part. Further, a computer is interfaced with the orchestrator and the data storage medium for causing the first and second parts of the tune to be simultaneously played in accordance with the first and second orchestration attributes.

Preferably, a digital synthesizer is electrically connected to the computer. Accordingly, the computer can generate a first control signal representative of the first part and a second control signal representative of the second part, and the synthesizer receives the control signals and generates an audible signal in response.

In one presently preferred embodiment, each digital data series includes a sequence of note bytes, and the tone and length of each note of the tune are represented by a respective single note byte. Furthermore, the device preferably includes an amen selector for generating an amen signal. As intended by the present invention, the computer receives the amen signal and causes the synthesizer to play a plagal cadence at the end of the tune.

At least one sound speaker and a portable housing are provided for holding the sound speaker, computer, data storage medium, and synthesizer. Desirably, a hand-held remote unit holds the input surface and establishes a means by which a user can remotely transmit the orchestration signal to the computer. If desired, a remote sound speaker can be electrically connected to the synthesizer.

In another aspect of the present invention, a digital hymnal includes a portable housing, and a plurality of four-part hymns, each having a digital representation, are stored in the housing. A hymn selector is provided for selecting one of the hymns for playing, and an orchestrator interactively establishes a respective orchestration attribute for each of the four parts of the hymn. Also, a computer is mounted in the housing and is operably engaged with the hymn selector and orchestrator for associating the respective orchestration attribute with the respective part of the hymn. In accordance with the present invention, the computer generates a control signal which is representative of each part and sends the control signal to a synthesizer system for generating an audible representation of the hymn.

In still another aspect of the present invention, a digital hymnal includes a plurality of electronically stored hymns, with each hymn being characterized by a tonic and each having a conclusion. Further, the digital hymnal includes a user-manipulable amen selector for generating an amen signal, as well as a hymn selector that is interfaced with the electronically stored hymns for selecting one of the hymns for playing. Means are provided for receiving the amen signal and for automatically generating a plagal cadence having a predetermined relationship to the tonic of the selected hymn at the conclusion of the hymn.

In yet another aspect of the present invention, an electronic music synthesizer device is disclosed for playing at least one prestored tune which is defined by a plurality of notes. The device of the present invention includes a data structure that is characterized by a plurality of data series, and each data series includes a plurality of note bytes. As envisioned by the present invention, each series represents a part of the tune, and the tone and length of each note of the tune are represented by a respective single note byte. An electronic data storage medium is included for storing the digital data structure, and a computer is interfaced with the data storage medium for causing an audible representation of the tune to be played in accordance with the data structure.

In another aspect of the present invention, an electronic music synthesizer device is disclosed. The device plays at least one prestored tune having at least first and second simultaneously-played parts, and includes first means for storing a first digital data series which is representative of the first part of the tune. The first means also stores a second digital data series which is representative of the second part of the tune.

Additionally, second means are provided for selectively generating an orchestration signal, and third means receive the orchestration signal and establish a first orchestration attribute for the first part and a second orchestration attribute for the second part in response thereto. Fourth means are interfaced with the first means and third means for causing the first and second parts of the tune to be simultaneously played in accordance with the first and second orchestration attributes.

In yet another aspect of the present invention, a method for playing at least one prestored tune having at least first and second simultaneously-played parts includes the steps of storing a first digital data series representative of the first part of the tune and a second digital data series representative of the second part of the tune. An orchestration signal is selectively generated, and a first orchestration attribute is established for the first part and a second orchestration attribute for the second part in response. Then, the first and second parts of the tune are simultaneously played in accordance with the first and second orchestration attributes.

The details of the present invention, both as to its structure and operation, can best be understood in reference to the accompanying drawings, in which like reference numerals refer to like parts, and in which:

DETAILED DESCRIPTION OF THE PREFERRED EMBODIMENT

Figure 1:
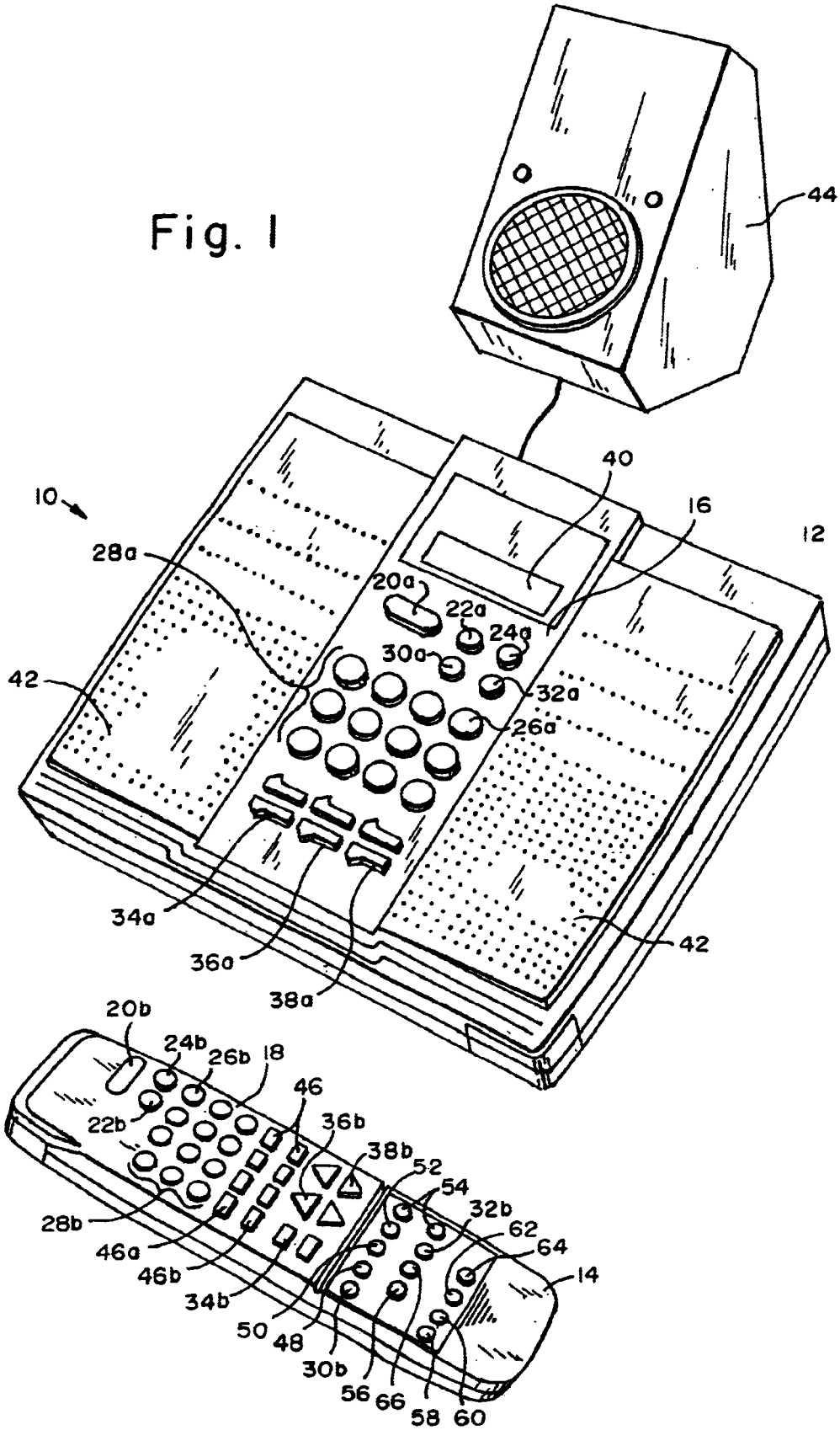
FIG. 1 is a perspective view of the music synthesizer system of the present invention.

Referring initially to FIG. 1, a music synthesizer system is shown, generally designated 10. As shown, the music synthesizer system 10 includes a portable hollow plastic housing 12 and a plastic hand-held remote unit 14 that can be used to generate user command signals and to transmit the command signals to the housing 12. To establish communication between the housing 12 and remote unit 14, the hand-held remote unit 14 includes a well-known light transmitter or rf transmitter and the housing 12 includes a complementary receiver.

FIG. 1 shows that the housing 12 includes a housing control surface 16, while the remote unit 14 includes a remote control surface 18. It is to be understood that each control surface 16, 18 includes control buttons reciprocally mounted thereon and mentioned below in reference to FIG. 1. The control buttons mentioned in reference to FIG. 1 can be manipulated by a user to generate one or more orchestration signals for use as described further in reference to FIG. 2.

As shown in FIG. 1, the control surfaces 16, 18 include a plurality of duplicative control buttons, so that a plurality of user orchestration signals, discussed in detail below, can be generated at the housing 12 or remotely using the remote unit 14 by depressing the appropriate button. More particularly, the control surfaces 16, 18 include respective power toggle buttons 20*a*, 20*b* for turning the system 10 on and off. Further, the control surfaces 16, 18 include respective stop/intro toggle buttons 22*a*, 22*b*. Still further, the control surfaces 16, 18 include respective play/pause toggle buttons 24*a*, 24*b*. Additionally, the control surfaces 16, 18 include respective enter buttons 26*a*, 26*b* and respective numeric keypads 28*a*, 28*b*.

FIG. 1 also shows that the control surfaces 16, 18 include respective verses toggle buttons 30*a*, 30*b* and style toggle buttons 32*a*, 32*b*. And, the control surfaces 16, 18 include respective increase/decrease pairs 34*a,b*, 36*a,b*, 38*a,b* for respectively transposing key up and down, quickening and slowing tempo, and increasing and decreasing volume. All of the buttons described above operate in accordance with well-known principles to generate electronic signals.

With specific regard to the housing 12, the housing 12 includes a display window 40 for displaying alpha-numeric characters representative of the attributes of the particular hymn being played. At least one and preferably two small audio speakers 42 are mounted on the housing 12. If desired, one or more remote sound speakers 44 may be electrically connected to components within the housing 12 by means well-known in the art to increase the decibel output of the system 10.

With specific regard to the remote unit 16, the unit 16 includes a plurality of, preferably eight, sound selection buttons 46. The remote unit 14 also includes a memory button 48, a metronome button 50, an amen selector button 52, and a browse up/down button pair 54. In the presently preferred embodiment, the remote unit 14 includes a solo select button 56 and four buttons that correspond to the four parts of a hymn. Specifically, the remote unit 14 includes a soprano/melody button 58, an alto/accompaniment "1" button 60, a tenor/accompaniment "2" button 62, and a bass/contra button 64. If desired, a demonstration button 66 can also be included to permit a means for the user to interactively command the system 10 to play a short pre-stored demonstration hymn.

Figure 2:
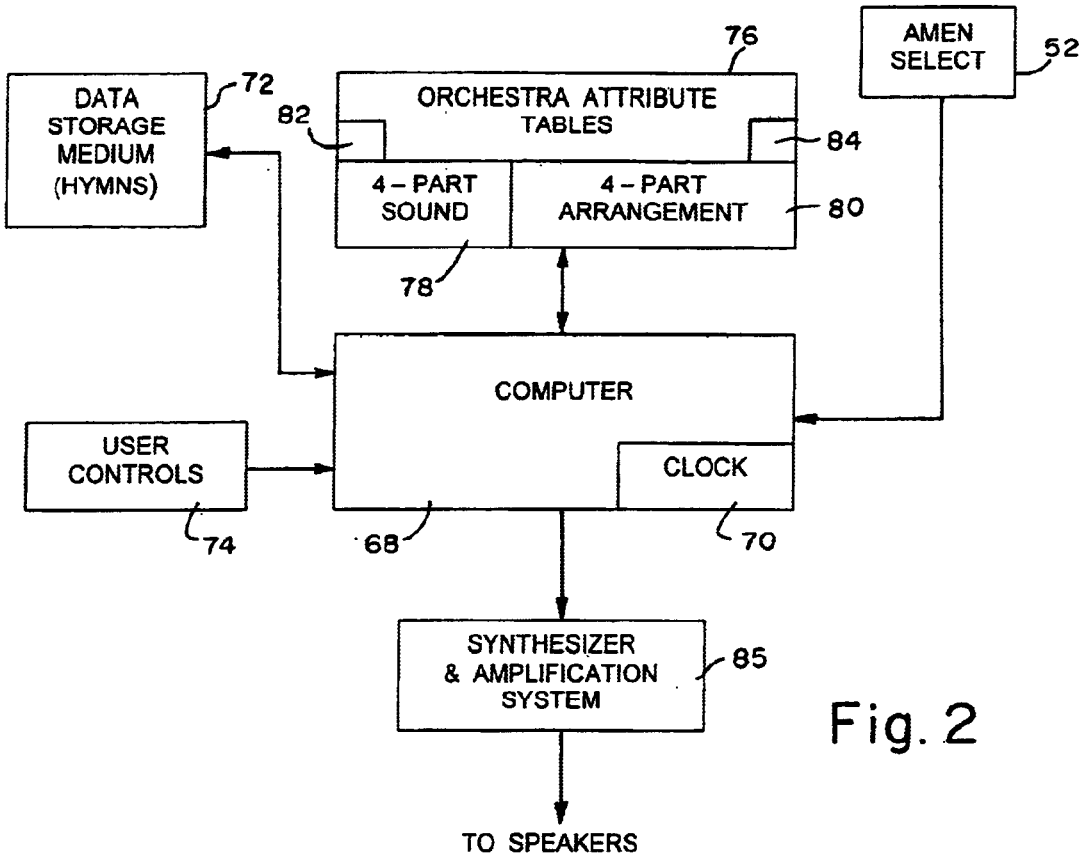
FIG. 2 is a schematic diagram of the electronic components of the synthesizer system.

Now referring to FIG. 2, the system 10 includes a computer 68 having a clock 70. The computer 68 includes a suitable microprocessor for performing the functions discussed below.

Further, the system 10 includes a computer-readable data storage medium 72 for storing a plurality of digitized four-part hymns. In the presently preferred embodiment, the data storage medium 72 is read-only memory (ROM) that is mounted in or otherwise accessible to the computer 68 for being read. Alternatively, the data storage medium can be an optical disk, magnetic disk, or magnetic tape. A particular hymn is recalled from memory by depressing the numerals that correspond to the hymn on one of the numeric keypads 28*a*, 28*b* and then depressing one of the enter buttons 26*a*, 26*b*.

FIG. 2 shows that the computer 68 receives an electronic amen signal generated by the amen selector button 52. Also, as schematically shown at block 74, electronic signals generated by the remainder of the control buttons mentioned above are sent to the computer 68 for universal operation as follows.

- stop/intro toggle buttons 22*a*, 22*b*—can be manipulated to cause the selected hymn to stop playing or, if not already playing, to cause the introduction of the hymn to be played.
- play/pause toggle buttons 24*a*, 24*b*—can be manipulated to cause the selected hymn to start playing or, if already playing, to pause until toggled again.
- enter buttons 26*a*, 26*b* are manipulated as conventional computer "enter" keys. For example, a hymn is selected by depressing the numerals that correspond to the hymn on one of the numeric keypads 28*a*, 28*b* and then depressing one of the enter buttons 26*a*, 26*b*. Thus, a hymn selector is established by one or of the buttons on the control surfaces 16, 18.
- verses toggle buttons 30*a*, 30*b* can be manipulated to define how many verses of the selected hymn are played.
- sound selection buttons 46 can be manipulated to define a universal sound for the selected hymn. For example, a hymn may be recalled, and then a sound selection button 46*a* can be depressed by the user to cause the hymn to be played with a sound characterized by the timbre of a choir (i.e., a sound having the timbre of a choir which hums the assigned part). Alternatively, a sound selection button 46*b* can be depressed by the user to cause the hymn to be played with a sound characterized by the timbre of a string ensemble, and so on.
- memory button 48—can be manipulated in conjunction with the numeric keypads 28*a*, 28*b* to store a subset of the hymns for automatically playing the hymns in sequence.
- metronome button 50—can be manipulated to cause the synthesizer system to generate the sound of a metronome.
- a browse up/down button pair 54 can be manipulated to play the immediately precedent or subsequent hymn in the data base to the hymn being played.

As also shown in FIG. 2, an orchestration attribute table 76 is accessible by the computer 68 in response to user-generated orchestration signals for associating one or more orchestration attributes with a selected hymn on a part-by-part basis, instead of on the universal basis described above. In the present embodiment, the orchestration attribute table 76 is a set of data tables electronically stored on a computer-readable storage medium, such as ROM, which may be mounted in or otherwise accessible to the computer 68 for being read.

In reference to FIG. 2, the orchestration attribute table 76 includes a four-part sound table 78 and a four-part arrangement table 80. The sound table 78 contains a plurality of pre-stored part-by-part simulated sounds, and the table is used for defining which simulated sound or sounds will be used for each part. The entering argument corresponding to each set of simulated sounds is a numeral which can be entered by the user by appropriately manipulating the numeric keypads 28*a* or 28*b* and the style toggle buttons 32*a* or 32*b*.

For example, the sound entering argument numeral "0" can correspond to a preset simulated sound orchestration in which a sound that is characterized by the timbre of a recorder is assigned to the melody/soprano part of the hymn, a sound characterized by the timbre of a piccolo is assigned to the alto/accompaniment "1" part, a sound characterized by the timbre of a flute is assigned to the tenor/accompaniment "2" part, and a sound characterized by the timbre of a clarinet is assigned to the contra/bass part. Likewise, the numeral "1" can correspond to assigning a pipe organ sound to all four parts. Moreover, the numeral "2" can correspond to a preset sound orchestration which assigns a flute to the melody/soprano part of the hymn, string I to the alto/accompaniment "1" part, choir 1 (a sound having the timbre of a choir which hums the assigned part) to the tenor/accompaniment "2" part, and a pipe organ to the contra/bass part. It is to be understood that other combinations of simulated sounds may be entered as desired in the sound table 78, including, e.g., combinations involving simulated brass, woodwind, and string instruments other than those mentioned above.

On the other hand, the four-part arrangement table 80 is used to define the way in which each of the four parts of the hymn is performed, and is entered with a numerical key generated by appropriately manipulating the numeric keypad 28*a* or 28*b*. For example, an arrangement entering argument of "0" can correspond to a basic arrangement which assigns each part its own part. Then, an arrangement entering argument "1" can correspond to an arrangement wherein the melody/soprano part is raised an octave, the alto/accompaniment "1" sound plays both the soprano and alto parts of the hymn, the tenor/accompaniment "2" sound plays both the tenor and bass parts of the hymn, and the bass/contra sound plays the bass part of the hymn down one octave. It is to be understood that other arrangements may be entered as desired in the arrangement table 80, e.g., assigning one or more parts to play arpeggiated chords.

As an example of how the user can create a particular combination of pre-stored sound and arrangement styles, the user depresses one of the style toggle buttons 32*a* or 32*b* and then enters "12". As intended by the present invention, the first numeral (i.e., "1") is the entering argument to the arrangement table 80, while the second numeral (i.e., "2") is the entering argument to the sound table 78. Thus, in the example, "flute" plays the melody/soprano part up an octave, and "string 1 " plays both the melody/soprano and alto/accompaniment "1" parts at pitch. Moreover, "choir 1 " plays both the tenor/accompaniment "2" and contra/bass parts at pitch. Still further, a "pipe organ" plays the contra/bass part down an octave.

It is to be understood that the orchestration attribute tables 76 can include tables in addition to those set forth above. For example, a contemporary music table 82 can be constructed which uses, as entering arguments, a two digit numeric code wherein the first numeral is, e.g., "9". The second numeral, in turn, indicates a particular arrangement using simulated sounds of contemporary instruments. For example, the entering argument "91" can correspond to an arrangement wherein the melody/soprano instrument is played by a pipe organ at pitch, and the remaining three parts are played as block chords by an electric piano, with a drum set playing a rhythm pattern (which pattern may be stored in ROM) in the background. The computer 68 can determine appropriate chords to play based upon the notes of the tune in accordance with the method disclosed in U.S. Pat. No. 4,941,387, assigned to the same assignee as the present invention and incorporated herein by reference.

Still further, a multi-verse table 84 can be constructed for varying the arrangement of the hymn verse-by-verse. When the multi-verse table 84 is to be invoked, the user inputs three numerals, with the first numeral being the entering argument for the multi-verse table 84, the second numeral being the entering argument for the arrangement table 80, and the third numeral being the entering argument for the sound table 78.

As an example, a multi-verse table 84 entering argument of "1" (derived from a user input of, e.g., "132") can cause a rallentando to be added to all four parts of the hymn at the end of the last verse of the hymn. In contrast, a multi-verse table 84 entering argument of "2" (derived from a user input of, e.g., "212") can increase the style entering argument to increase by one with each new verse. Thus, in the example given above, the first verse of the hymn will be played with arrangement style 1 and sound style 2, the second verse will be played with arrangement style 1 and sound style 3, and so on. It is to be understood that other multi-verse variations may be entered as desired in the multi-verse table 84.

In addition to orchestrating a selected hymn part-by-part using what is essentially a pre-stored matrix comprising the orchestration attribute tables 76, a user of the system 10 may orchestrate each part of a hymn independent of any pre-stored orchestration scheme. More particularly, a user may isolate a single part of a hymn by depressing the solo select button 56 and then depressing any one the soprano/melody button 58, alto/accompaniment "1" button 60, tenor/accompaniment "2" button 62, and bass/contra button 64 to indicate that the particular part selected is to be assigned a sound. Next, the user enters a numeral on one of the keypads 28*a*, 28*b* which corresponds to one of a plurality of prestored "sounds", and then depresses the enter button 26*a* or 26*b* to thereby assign the selected sound to the selected part. In the preferred embodiment, a subset of the General MIDI® sound catalogue is stored in the computer 68, and the computer 68 assigns the selected orchestration to the particular part.

Also, it will be appreciated that a user may orchestrate all four parts of a selected hymn by assigning a sound as described above to each of the four parts in turn. Moreover, a user may "mix" the parts of a hymn by depressing the appropriate part selection button 58, 60, 62, 64 and then manipulating the volume increase/decrease pair 38*a* or 38*b* as appropriate to change the volume of the selected part.

Thus, the orchestration attribute tables 76 establish an orchestrator for receiving the orchestration signal generated by the user and establishing respective orchestration attributes for the parts of the hymn. Stated differently, the orchestration attribute tables 76 establish an orchestrator for interactively establishing a respective orchestration attribute for each of the four parts of the hymn. Moreover, the computer 68, in conjunction with operation of the solo select button 56, soprano/melody button 58, alto/accompaniment "1" button 60, tenor/accompaniment "2" button 62, and bass/contra button 64 also establishes an orchestrator.

FIG. 2 shows that the computer 68 sends a respective control signal representative of each part of the hymn to a synthesizer and amplification system 85. The synthesizer and amplification system 85 can be any suitable electronic music synthesizer, such as one of the synthesizers made by the assignee of the present invention, which generates a variety of sounds based upon a computer-generated control signal.

In accordance with principles well-known in the synthesizer art, each sound generated by the synthesizer system 85 is partially characterized by a timbre that closely simulates an actual instrument or choir. Each sound is also characterized by a volume, tone (pitch), and length. Accordingly, the computer 68 sends control signals to the synthesizer system 85 that are representative of each tone to be played, the length of the tone, the volume of the tone, and the simulated instrument (acoustic timbre) with which the note is to be played. In accordance with the presently preferred embodiment, the speakers 42, computer 68, data storage medium 72, and synthesizer system 85 are mounted by means well-known in the art in the housing 12.

Figure 3:
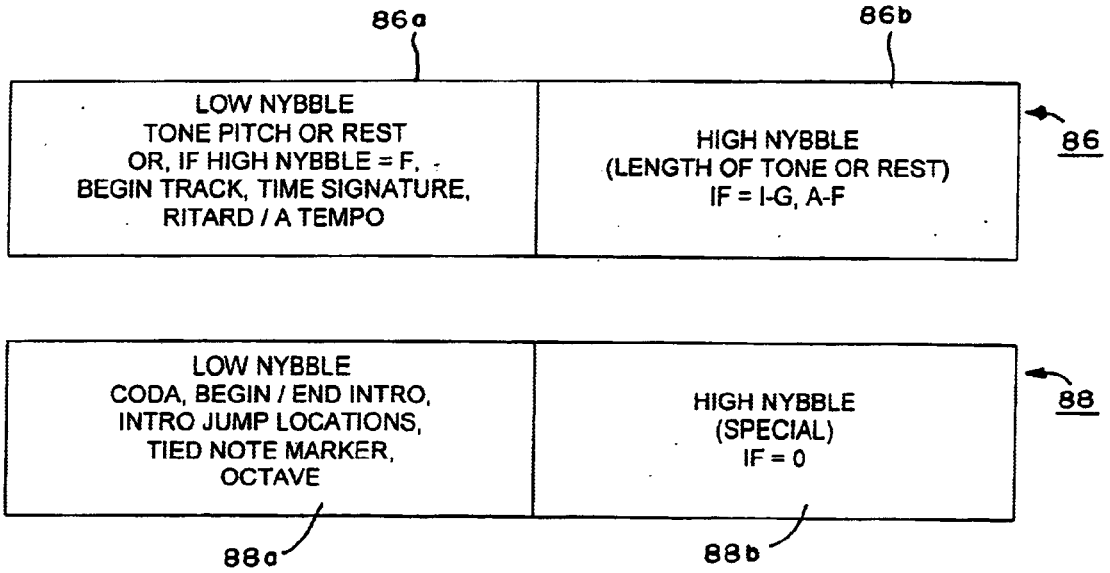
FIG. 3 is a schematic diagram of the data structure of the present invention.

FIG. 3 shows the preferred data structure of the present invention for storing hymns in the data storage medium 72 (shown in FIG. 2). In cross-reference to FIG. 3 and Table 1, each of the parts of each hymn is represented by a respective digital data series, each data series including a sequence of 8-bit note bytes 86 and direction bytes 88.

Each note byte 86 consists of a 4-bit low nybble 86*a* and a 4-bit high nybble 86*b* which together represent a musical tone or a rest and a corresponding time interval for holding the tone or rest. The sixteen possible values of each nybble 86*a,b* are notated using standard hexadecimal notation, i.e., the possible values range from 0–9 and A–F. In the presently preferred embodiment, the values of the high nybble 86*b* correspond to the following codes:

F=dotted whole note (or dotted whole rest when value of low nybble 86*a* is E). However, a high nybble 86*b* value of "F" has a special connotation when the value of the low nybble 86*a* is F, D, or C as discussed below.
E=whole note (or rest)
D=dotted half note (or rest)
C=half note (or rest)
B=dotted quarter note (or rest)
A=quarter note (or rest)

9=dotted eighth note (or rest)
8=eighth note (or rest)
7=dotted sixteenth note (or rest)
6=sixteenth note (or rest)
5=thirty-second note (or rest)
4=quarter note triplet
3=eighth note triplet
2=sixteenth note triplet
1=thirty-second note triplet
0=special code (if set, indicates a direction byte)

Thus, the skilled artisan will recognize that the high nybble 86*b* may represent a time interval for holding the tone or rest of a tune. Also, the high nybble 86*b* may represent a triplet.

When the value of the high nybble 86*b* is other than 0 (i.e., when the byte 86 is a note byte), the values of the low nybble 86 a correspond to the following codes F=Begin track marker (used when high nybble 86*b*=F)
E=rest
D=time signature of next two bytes (used when high nybble 86*b*=F)
C=ritardando (used when high nybble 86*b*=F)
B=B natural/C flat
A=B flat/A sharp
9=A natural
8=A flat/G sharp
7=G natural
6=F sharp/G flat
5=F natural/E sharp
4=E natural/F flat
3=E flat/D sharp
2=D natural
1=C sharp/D flat
0=C natural/B sharp Thus, the skilled artisan will recognize that the low nybble 86*a* may represent a musical tone or a rest. Alternatively, in certain circumstances (when the high nybble 86*b*=F) the low nybble 86*a* may represent a marker or time code.

In contrast, when the value of a high nybble=0, the high nybble is a direction high nybble such as the high nybble 88*b*. The values of the direction low nybble 88*a* are as follows:

F=coda marker
E=end of introductory phrase
D=begin intro
C=for intro—jump forward to XX marker
B=for intro—XX marker
A=end intro
9=tie (precedes bytes of two notes which are to be tied)
8=octave 00 (C00-B00)
7=octave 7 (C7-B7)
6=octave 6 (C6-B6)
5=octave 5 (C5-B5)
4=octave 4 (C4-B4)
3=octave 3 (C3-B3) (middle C=C3)
2=octave 2 (C2-B2)
1=octave 1 (C1-B1)
0=octave 0 (C0-B0)

Table 1 provides a sample hymn digitally represented in accordance with the above discussion. As shown in Table 1, in the preferred embodiment the four parts of a hymn are recorded sequentially. It is to be understood, however, that the four parts may alternatively be recorded in parallel. Further, a header sequence follows the recorded parts for defining certain initial attributes of the tune, some of which can be interactively varied by the user as discussed above. These attributes include initial time signature, beat unit, tempo, number of verses, starting beat tick, and key.

Figure 4:
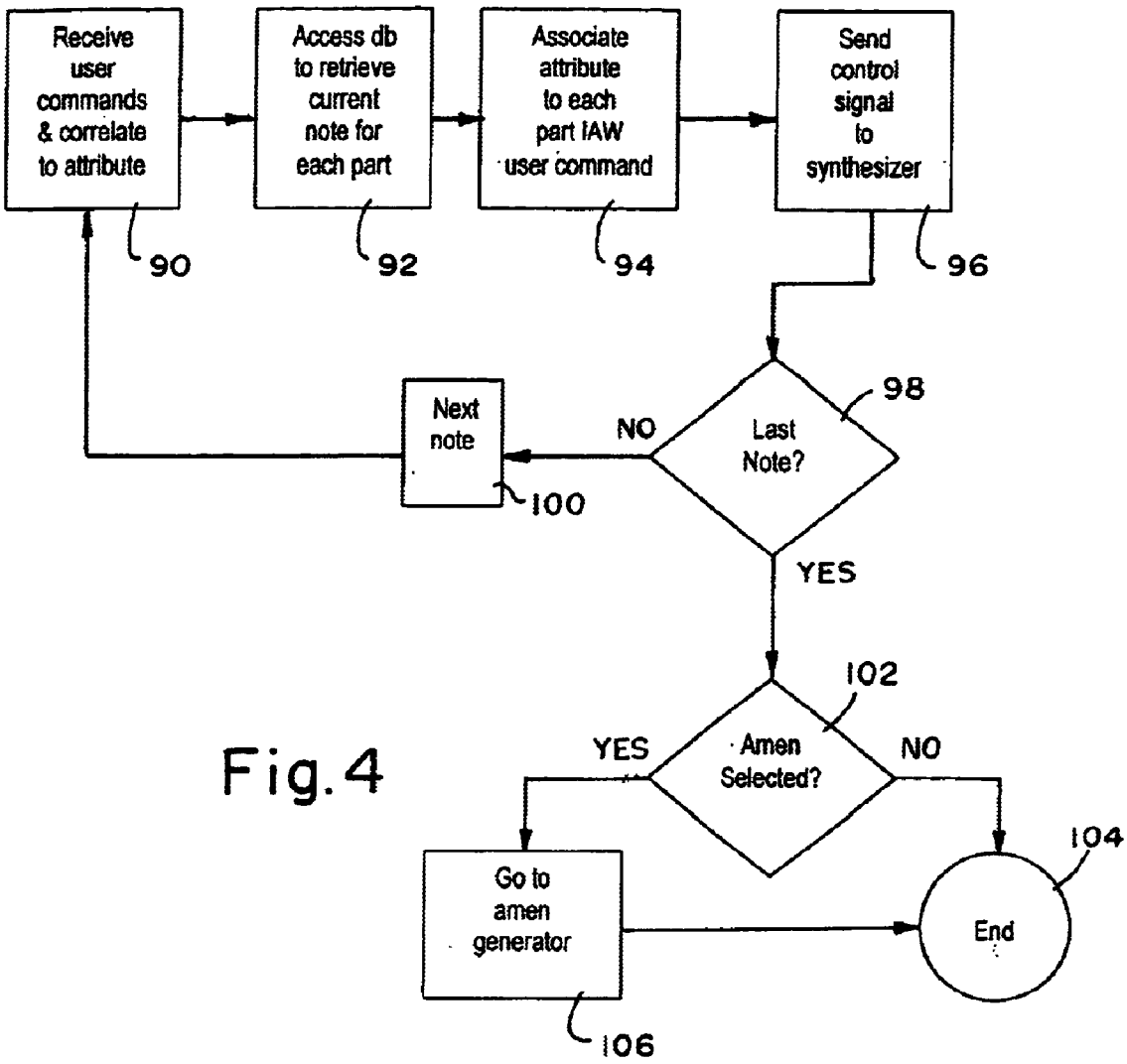
FIG. 4 is a logic flow chart of the orchestrator of the present invention.
Figure 5A:
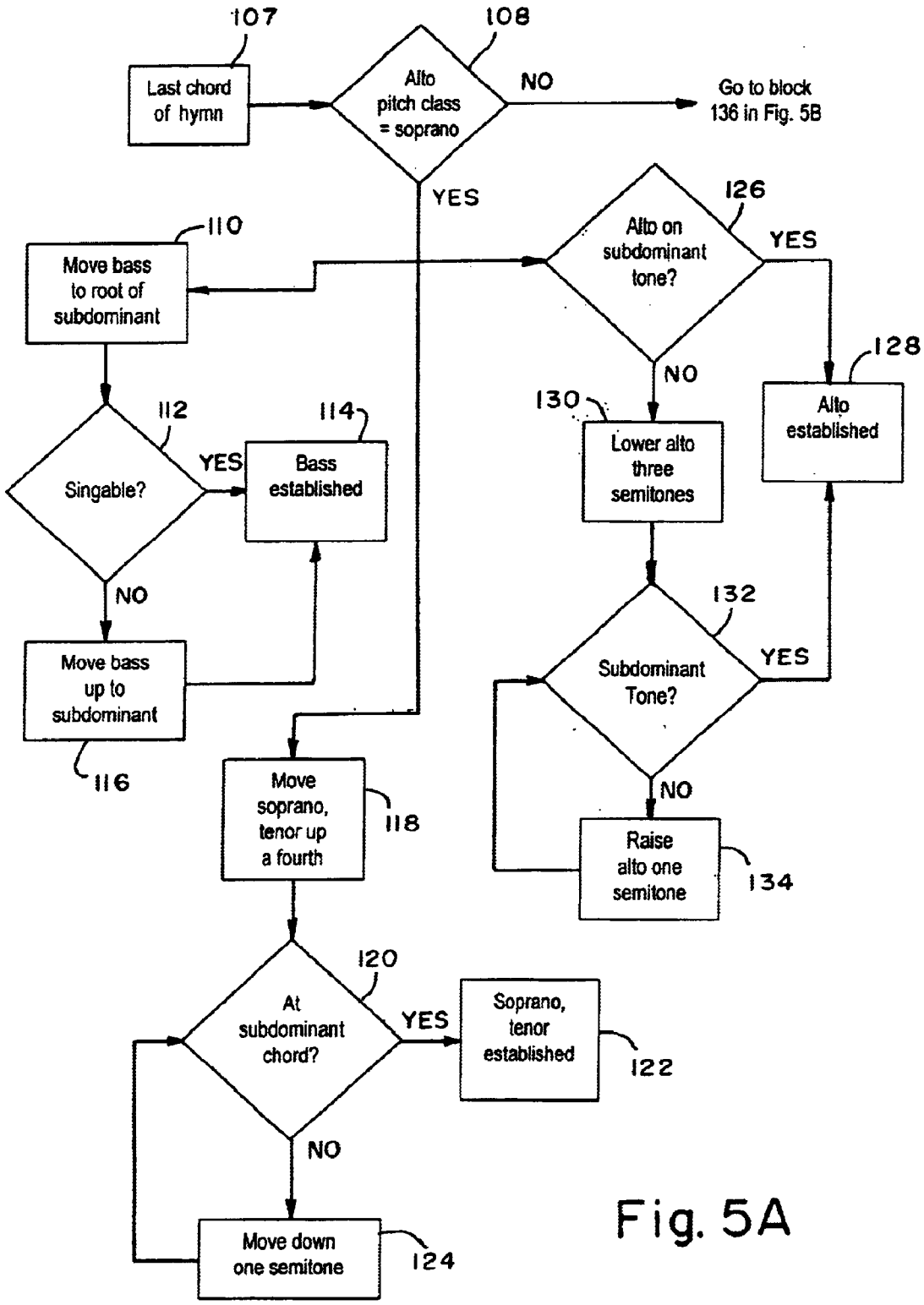
FIGS. 5A, 5B, and 5C form a logic flow chart of the amen generator of the present invention in generating the first part of the plagal cadence.
Figure 5B:
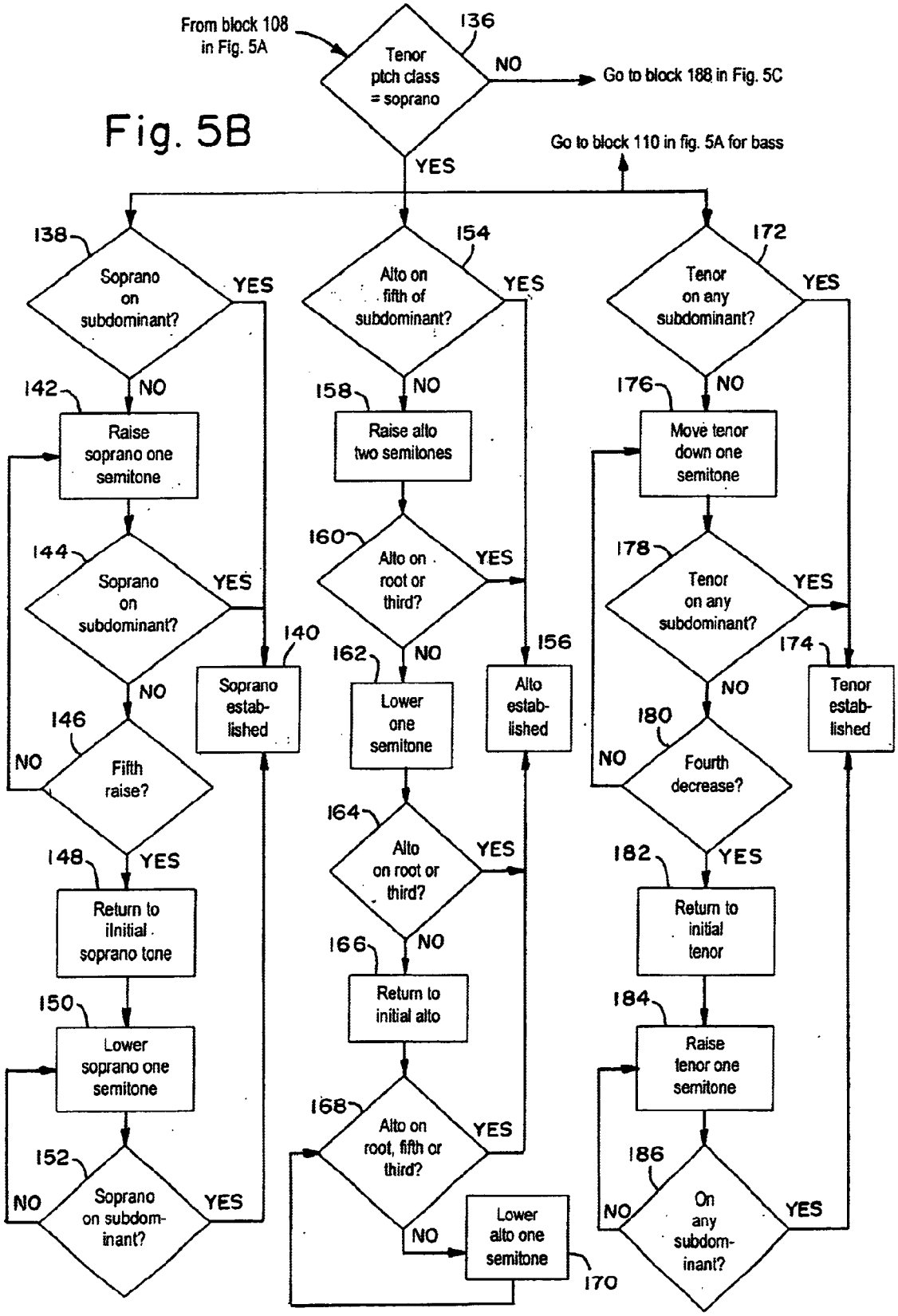
Figure 5C:
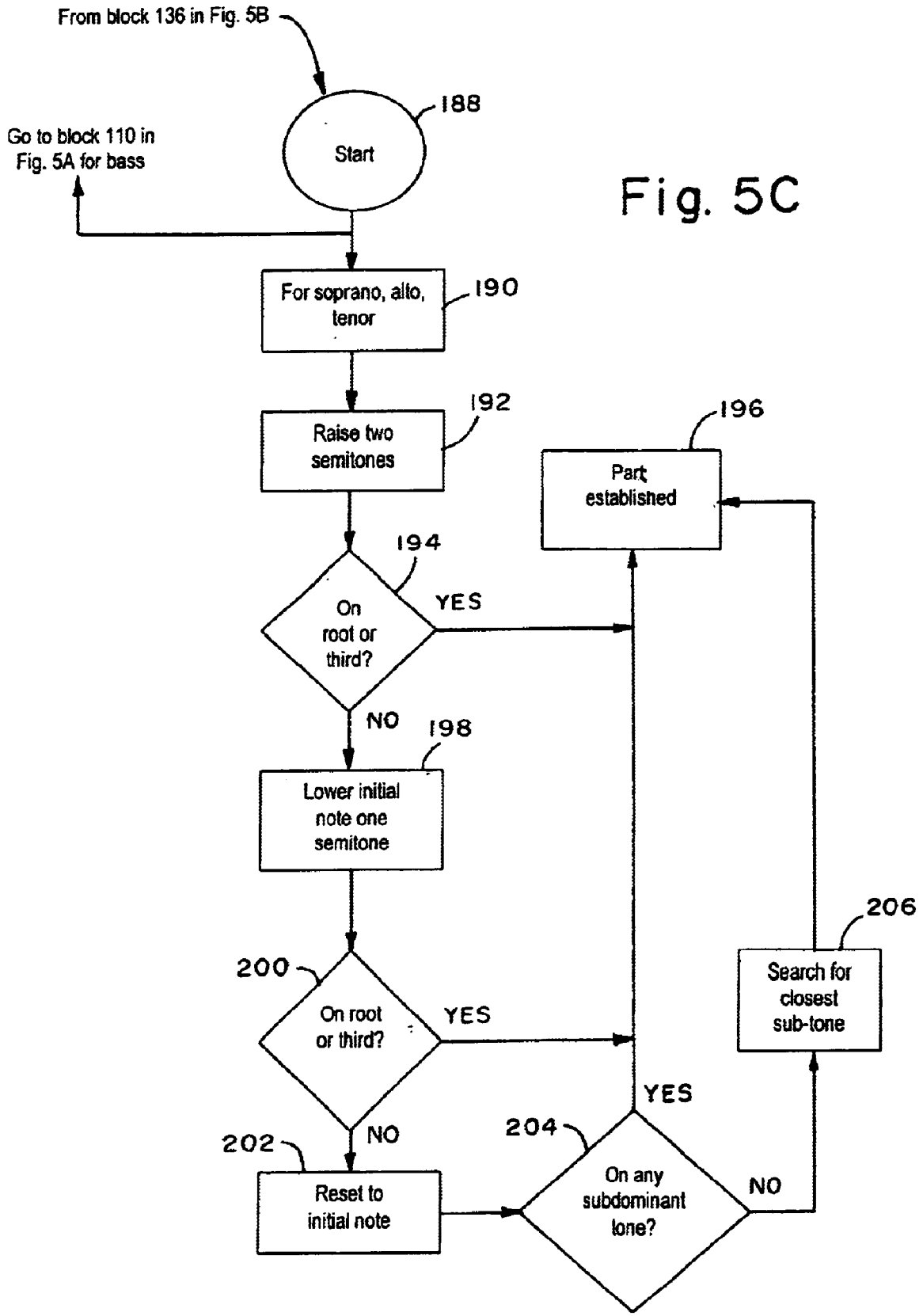
Figure 6:
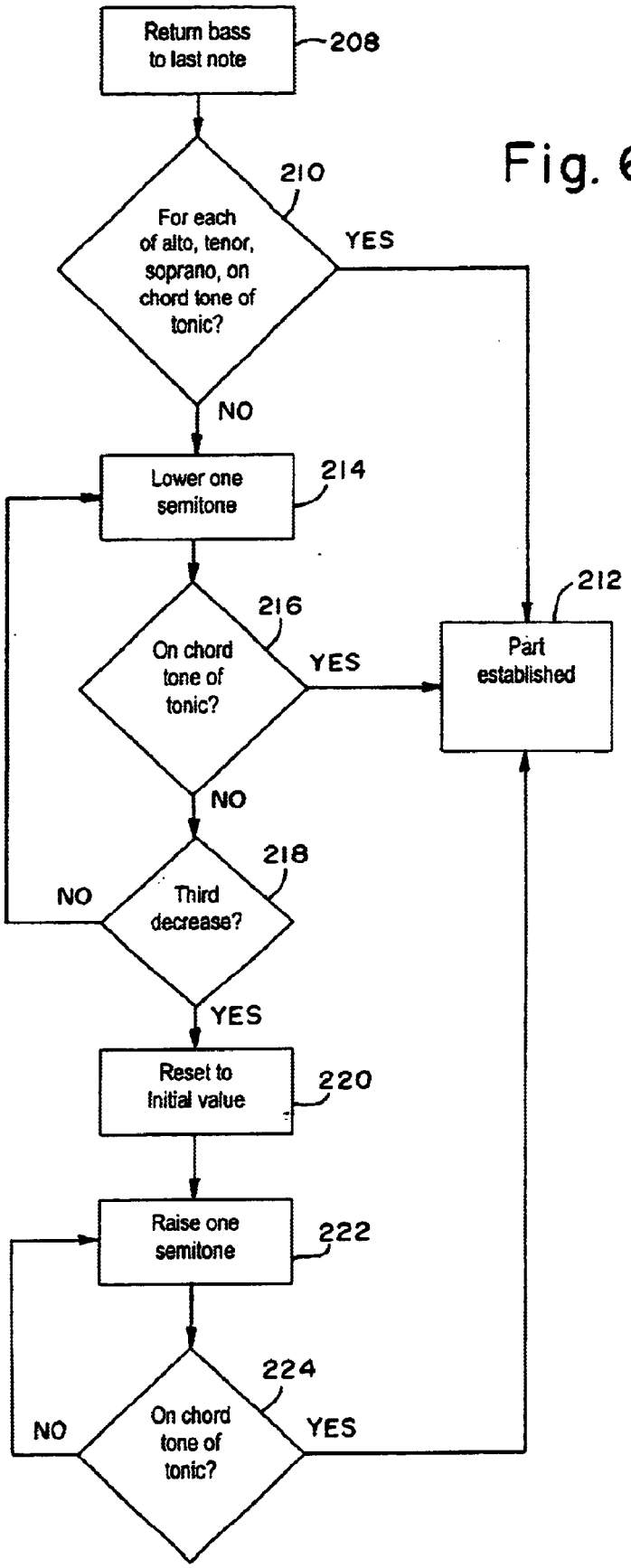
FIG. 6 is a logic flow chart of the amen generator of the present invention in generating the second part of the plagal cadence.

Refer now to FIGS. 4–6 for an understanding of the structure of a software program for controlling the overall operation of the computer 68 according to the present invention. The software program may be embodied, for example, in an application program written in a well-known computer language such as "C", or in a compiled and linked machine-language program. It is to be understood that the present invention extends to a program product embodying a set of instructions that configure the computer 68 for operation according to the principles disclosed herein. Moreover, it is to be further understood that the present invention also encompasses a program product embracing a set of instructions for causing the computer 68 to execute a method having steps according to FIGS. 4–6.

In particular reference to FIG. 4, at block 90, the computer 68 receives hymn selection signals and orchestration signals generated by a user by means discussed above. Also at block 90 the computer 68 correlates the orchestration signals to orchestration attributes using the orchestration tables 76 or by correlating signals from the solo button 56 and associated part buttons 58–64 with their designated attributes. Accordingly, block 90 establishes an orchestrator for receiving the orchestration signal and establishing an orchestration attribute for each of the parts of the hymn. Stated differently, block 90 provides a means for interactively establishing a respective orchestration attribute for each of the four parts of the hymn.

At block 92, the computer 68 accesses the hymn data base that is electronically stored on the data storage medium 72 to retrieve the current note or rest to be played for each of the four parts. Then, the computer 68 proceeds to block 94 and associates the orchestration attributes with the note of the designated part of the hymn.

In associating the orchestration attributes with their designated part, the computer 68 generates a control signal as discussed above and at block 96 sends the control signal to the synthesizer system 85. In response, the synthesizer system 85 simultaneously plays each of the four notes in accordance with the orchestration attributes.

After sending the control signal to the synthesizer system 85, the computer proceeds to decision block 98 to determine whether the last note of the hymn has been played. If not, the computer 68 proceeds to block 100 to retrieve the next note for each part from the data base, and then returns to block 90.

On the other hand, if the last note has been played, the computer 68 proceeds to decision block 102 to determine whether the user has generated an amen signal by depressing the amen selector button 52. If not, the computer 68 ends at circle 104. Otherwise, the computer 68 proceeds to block 106 and thence to the amen generation steps discussed below, wherein the computer generates a plagal amen cadence and causes the synthesizer to play the generated amen.

FIGS. 5A, 5B, and 5C show the steps executed in generating the first note of two notes of a plagal cadence in response to the user having generated an amen signal. The steps discussed below provide for automatically generating an "amen" cadence. Generally, it is assumed that the last chord of the hymn is tonic in root position, and that for an appropriate "amen" cadence, the first chord is the subdominant of the tonic and the second chord is the tonic. The method discussed below is appropriate whether the key is major or minor. If the key is minor, however, the method below may employ a Picardy third.

Beginning at block 107, at the last chord of a hymn, the computer 68 in decision block 108 whether, for the last chord, the alto pitch class equals the soprano pitch class. If so, the computer 68 proceeds in parallel to blocks 110, 118, and 126. Otherwise, the computer 68 proceeds to block 136.

At block 110, the computer moves the bass note to the root of the subdominant of the hymn. Then, at block 112, the computer 68 determines whether the new bass note is humanly singable, i.e., whether the pitch of the new bass note is equal to or higher than a threshold value. If it is, the computer 68 proceeds to block 114 and establishes the bass note of the first chord of the plagal cadence to be the root of the subdominant. Otherwise, the computer 68 moves to block 116 to shift the bass up to the subdominant, and thence to block 114 to establish the bass note of the first chord of the plagal cadence to be the subdominant.

Also, at block 118 the computer 68 shifts each of the last soprano and tenor notes of the hymn up a fourth, and then tests at decision block 120 whether the note under test is on a subdominant chord tone. If so, the computer 68 establishes the note as the first note of the "amen" for its respective part at block 122. Otherwise, the computer 68 moves to block 124 to shift the note down one semitone, and then the computer 68 returns to block 120 to incrementally shift the note down by semitones until a subdominant tone is reached.

Additionally, at decision block 126 the computer 68 tests whether the last alto note of the hymn is on a subdominant chord tone. If so, the computer 68 establishes the note as the first note of the "amen" for the alto part at block 128. Otherwise, the computer 68 moves to block 130 to shift the note down three semitones, and then at decision block 132 tests whether the shifted note is on a subdominant tone. If so, the computer 68 proceeds to block 128. Otherwise, the computer 68 moves to block 134 to raise the note one semitone, and then loops back to decision block 132 to retest the note.

The flow chart of FIGS. 5A, 5B, and 5C also shows that when the pitch class of the last alto note of the hymn does not equal the pitch class of the last soprano note of the hymn, the computer 68 proceeds to decision block 136 (FIG. 5B) to determine whether the pitch class of the last tenor note of the hymn equals the pitch class of the last soprano note of the hymn. If not, the computer 68 proceeds to block 188 in FIG. 5C. Otherwise, the computer 68 proceeds in parallel to decision blocks 138, 154, and 172.

At decision block 138, the computer 68 determines whether the last soprano note of the hymn is on a subdominant chord tone. If so, the computer 68 establishes the note as the first note of the "amen" for the soprano part at block 140. Otherwise, the computer 68 moves to block 142 to shift the note up one semitone, and then at decision block 144 tests whether the shifted note is on a subdominant tone. If so, the computer 68 proceeds to block 140. Otherwise, the computer 68 moves to decision block 146.

At decision block 156, the computer 68 determines whether the soprano has been raised five times. If not, the computer 68 loops back to block 142 to raise the soprano yet another semitone, and then retests the note at decision block 144.

On the other hand, if, at decision block 156, the computer 68 determines that the soprano has been raised five semitones without reaching a subdominant chord tone, the computer 68 proceeds to block 148 to return the soprano to its initial pitch (i.e., the soprano note of the last chord of the hymn), and then shifts the soprano down one semitone at block 150. Then, at decision block 152, the computer 68 determines whether the soprano is on a chord tone of the subdominant. If so, the computer 68 proceeds to block 140. Otherwise, the computer 68 loops back to block 150, and continues to incrementally shift the soprano downwardly by semitones until a subdominant tone is reached.

At decision block 154, the computer 68 determines whether the last alto note of the hymn is on a fifth of the subdominant chord tone. If so, the computer 68 establishes the note as the first note of the "amen" for the alto part at block 156. Otherwise, the computer 68 moves to block 158 to shift the note up two semitones, and then at decision block 160 tests whether the shifted note is on a root or a third of the subdominant tone. If so, the computer 68 proceeds to block 156. Otherwise, the computer 68 moves to block 162.

At block 162, the computer 68 lowers the alto one semitone, and then tests whether the shifted note is on a root or a third of the subdominant at decision block 164. If so, the computer 68 moves to block 156. Otherwise, the computer 68 returns the alto to its initial pitch (i.e., the alto note of the last chord of the hymn) at block 166, and then tests whether the note is on a root, fifth, or third of the subdominant at decision block 168. If it is, then the computer 68 proceeds to block 156. If it is not, then the computer 68 proceeds to block 170 to lower the alto one semitone, and then loops back to block 168 to retest whether a root, fifth, or third of the subdominant has been reached. It will be appreciated that the computer 68 incrementally shifts the alto downwardly by semitones until a root, fifth, or third of the subdominant has been reached.

Continuing with the description of the operation of the computer 68 shown in FIGS. 5A, 5B, and 5C, at block 172 the computer 68 shifts the tenor down one semitone, and then at decision block 174 tests whether the shifted note is on a subdominant tone. If so, the computer 68 proceeds to block 176 to establish the current note as the tenor note. Otherwise, the computer 68 moves to block 184.

At block 184, the computer 68 shifts the tenor up one semitone, and then loops back to decision block 174 to continue to incrementally shift the tenor upwardly by semitones until a subdominant tone is reached. From block 136, the computer 68 also moves to block 110 to establish the first bass note of the amen plagal cadence.

If neither the last alto note nor last tenor note of the hymn equals the pitch class of the last soprano note of the hymn, the computer 68 proceeds to start circle 188 and then, to establish each of the soprano, alto, and tenor tones of the first note of the "amen", the computer 68 proceeds to block 190. In contrast, to establish the bass tone of the first note of the "amen", the computer 68 proceeds to block 110.

From block 190, the computer 68 moves to block 192 to raise the note under test two semitones. Then at decision block 194, the computer 68 tests the note to determine whether it is on a root or a third of the subdominant. If it is, the computer 68 proceeds to block 196 to establish the tone of the part under test as the first note for the part in the "amen". Otherwise, the computer 68 moves to block 198 and lowers the current note one semitone.

Next, at decision block 200, the computer 68 determines whether the shifted note is on a root or a third of the subdominant. If it is, the computer 68 proceeds to block 196. Otherwise, the computer 68 moves to block 202 to reset the note to its initial tone, and thence to decision block 204 to determine whether the note is on any subdominant chord tone. If the test at decision block 204 is positive, the computer 68 moves to block 196. Otherwise, the computer 68 moves to block 206 to prevent the playing of the note.

FIG. 6 shows how the computer 68 establishes the second chord of the "amen" plagal cadence. In FIG. 6, the computer 68 uses, as the starting note in considering each part, the corresponding note for the first chord as determined in FIG. 5.

At block 208, the bass is returned to the bass tone of the last chord of the hymn. Then, for each of the remaining three parts, the computer 68 undertakes the determination beginning at decision block 210.

At decision block 210, the computer 68 determines whether the part under test is on a chord tone of the tonic of the hymn. If it is, the computer 68 moves to block 212 and establishes the note as the second note of the "amen" of the part under. Otherwise, the computer 68 moves to block 214 to shift the note down one semitone, and then at decision block 216 tests whether the shifted note is on a chord tone of the tonic. If so, the computer 68 proceeds to block 212. Otherwise, the computer 68 moves to decision block 218.

At decision block 218, the computer 68 determines whether the tone of the part has been decreased three times. If not, the computer 68 loops back to block 214 to lower the part another semitone, and then retests the note at decision block 216.

On the other hand, if, at decision block 218, the computer 68 determines that the part has been decreased three semitones without reaching a tonic chord tone, the computer 68 proceeds to block 220 to return the note of the part under test to its initial pitch (i.e., the first note of the amen), and then shifts the part up one semitone at block 222. Then, at decision block 224, the computer 68 determines whether the part is on a chord tone of the tonic. If so, the computer 68 proceeds to block 212. Otherwise, the computer 68 loops back to block 222, and continues to incrementally shift the part upwardly by semitones until a tonic tone is reached.

While the particular digital hymnal as herein shown and described in detail is fully capable of attaining the above-described objects of the invention, it is to be understood that it is the presently preferred embodiment of the present invention and is thus representative of the subject matter which is broadly contemplated by the present invention, that the scope of the present invention fully encompasses other embodiments which may become obvious to those skilled in the art, and that the scope of the present invention is accordingly to be limited by nothing other than the appended claims.

TABLE 1

```
Here is a typical hymn with comments. /* indicates a comment */
ff, /* begin track for soprano */
/* time signature: */ fd,04,04,
/* end of track 0 */
ff,
od, /* begin intro marker */
a3,c0,a4,a7,04,d0,03,a9,b5,85,c4,c2,a4,
a5,a7,a9,ab,04,a0,0c, /* for intro - jump forward to XX marker */
d2,03,a7,04,a0,03,8b,04,80,
03,b9,89,d7,ab,ab,ab,04,b0,80,a0,03,aa,c9,ae,a9,
a9,a9,04,b2,80,03,ab,04,a0,0b, /* for intro - XX (we jump to here) marker */
03,db,04,a0,03,a5,
84,85,a4,a2,e0,0a, /* end of intro marker */
/* end of track 1 */
ff, /* begin track for alto */
0d, /* begin intro marker */
03,c0,a4,a2,d0,a0,a0,02,ab,03,c0,02,cb,
03,a0,02,ab,03,a0,a2,a5,a4,0c, /* for intro - jump forward to XX marker */
d2,a2,84,86,a7,a7,
a6,d7,a2,a2,a2,a0,a4,a5,a7,c5,ae,a0,a0,a2,b5,84,
a2,a4,0b, /* for intro - XX (we jump to here) marker */
d2,a0,80,02,8b,03,a0,a0,02,ab,03,e0,0a, /* end of intro marker */
/* end of track 2 */
ff, /* begin track for tenor */
0d, /* begin intro marker */
03,c0,a0,a2,d4,02,a9,a9,a5,c7,c7,a7,a5,
d4,a9,a5,a7,0c, /* for intro - jump forward to XX marker */
db,03,a2,a0,a2,b2,82,02,db,a7,a7,
a7,a7,03,a0,a0,a0,c0,ae,02,a9,a9,a5,b7,87,a7,a7,
0b, /* for intro - XX (we jump to here) marker */
d7,a7,a5,a7,b7,85,e4,0a, /* end of intro marker */
/* end of track 3 */
ff, /* begin track for bass */
0d, /* begin intro marker */
02,c0,03,a0,02,ab,d0,a5,b2,82,c0,01,c7,
02,a0,a2,a4,a5,a2,a0,0c, /* for intro - jump forward to XX marker */
d7,01,ab,a9,a7,02,b2,82,
01,d7,02,a7,a7,a5,a4,a0,a2,a4,c5,ae,a5,a5,82,80,
01,bb,02,80,a7,a0,0b, /* for intro - XX (we jump to here) marker */
d7,a4,a2,a0,a7,01,a7,02,e0,
0a, /* end of intro marker */
/* end of track 4 */
ff, /* begin track for header */
04, /* start numerator and */
04, /* denominator 4/4      */
18, /* Beat unit          */
60, /* tempo in beats per minute */
04, /* verses             */
00, /* starting_beat tick    */
```

TABLE 1-continued

| | |
|---|---|
| 00, /* key: C | */ |
| 00, /* major | */ |

What is claimed is:

1. A music synthesizer device for playing at least one prestored tune characterized by at least first and second simultaneously-played parts of harmony, comprising:

a data storage medium;

a first data structure stored in the data storage medium, the first data structure including a first digital data series representing the first part of harmony of a tune;

a second data structure stored in the data storage medium, the second data structure including a second digital data series representing the second part of the harmony of the tune;

a manipulable input surface for generating an orchestration signal in response to manipulation of the input surface by a user;

an orchestrator for receiving the orchestration signal and establishing a first orchestration attribute for the first part of harmony and a second orchestration attribute for the second part of harmony in response to the orchestration signal;

a computer interfaced with the orchestrator and the data storage medium for causing the first and second parts of harmony to be simultaneously played in response to the first and second digital data series and in accordance with the first and second orchestration attributes; and an amen selector for generating an amen signal, wherein the computer receives the amen signal and causes the music to play a plagal cadence at the end of the tune.

2. The music synthesizer device of claim 1, further comprising a digital synthesizer electrically connected to the computer, wherein the computer generates a first control signal representative of the first part of harmony and a second control signal representative of the second part of harmony, and the synthesizer generates the tune in response to the first and second control signals.

3. The music synthesizer device of claim 2, wherein each digital data series comprises a sequence of note bytes, and the tone and length of each note of the tune are represented by a respective single note byte.

4. The music synthesizer device of claim 1, further comprising at least one sound speaker and a portable housing for holding the sound speaker, computer, data storage medium, and synthesizer.

5. The music synthesizer device of claim 4, further comprising a hand-held remote unit for holding the input surface and for transmitting the orchestration signal to the computer.

6. The music synthesizer device of claim 5, further comprising at least one remote sound speaker electrically connected to the synthesizer.

7. A digital hymnal, comprising:

a portable housing;

a plurality of four-part hymns having digital representations stored in the housing;

a hymn selector for selecting one of the hymns for playing;

an orchestrator for interactively establishing a respective orchestration attribute for each of the four parts of the hymn;

a computer mounted in the housing and operably engaged with the hymn selector and orchestrator for associating the respective orchestration attribute with the respective part of the hymn and for generating a control signal representative of each part in response to the digital representations;

a synthesizer system for receiving the control signal and generating an audible representation of the hymn in response thereto; and an amen selector for generating an amen signal in response to a user-generated command signal, wherein the computer receives the amen signal and causes the synthesizer system to play a plagal cadence at the end of the hymn.

8. The digital hymnal of claim 7, wherein each part of the hymn is represented by a respective series of digital note bytes, and wherein the tone and length of each note of the hymn are represented by a respective single note byte.

9. A digital hymnal, comprising:

a plurality of electronically stored hymns, each characterized by a tonic and each having a conclusion;

a user-manipulable amen selector for generating an amen signal;

a hymn selector interfaced with the electronically stored hymns for selecting one of the hymns for playing; and means for receiving the amen signal and for automatically generating a plagal cadence having a predetermined relationship to the tonic of the selected hymn at the conclusion of the hymn.

10. The digital hymnal of claim 9, wherein each hymn has a plurality of parts, and the digital hymnal further comprises:

an orchestrator for establishing a respective orchestration attribute for each of the parts of the hymn.

11. The digital hymnal of claim 10, wherein the plagal cadence generating means is a computer operably engaged with the hymn selector and orchestrator for associating the respective orchestration attribute with the respective part of the hymn and for generating a control signal representative of each part; and a synthesizer system for receiving the control signal and generating an audible representation of the hymn in response thereto.

12. The digital hymnal of claim 11, wherein each part of the hymn is represented by a corresponding digital series of note bytes, and the tone and length of each note of the hymn are represented by a respective single note byte.

13. An electronic music synthesizer device for playing at least one prestored tune defined by a plurality of notes, comprising:

a plurality of digital data structures, each digital data structure including a respective data series including note bytes, wherein each series represents a part of harmony and wherein the tone and length of each note of the tune are represented by a respective single note byte;

an electronic data storage medium for storing the digital data structures;

a computer interfaced with the data storage medium for causing an audible representation of the tune to be played in accordance with the plurality of digital data structures; and an amen generator for automatically generating a plagal cadence having a predetermined relationship to a tonic of the tune at the conclusion of the tune.

14. The electronic music synthesizer device of claim 13, wherein each tune has a plurality of parts of harmony, further comprising:

an orchestrator for interactively establishing a respective orchestration attribute for each of the parts of harmony, wherein the computer associates the respective orchestration attribute with the associated part of harmony and generates a control signal representative of each part of harmony; and a synthesizer system for receiving the control signal and generating an audible representation of the tune in response thereto.

15. An electronic music synthesizer device for playing at least one prestored tune having at least first and second simultaneously-played parts of harmony, comprising:

first means for storing a first digital data series representative of the first part of harmony of the tune and a second digital data series representative of the second part of harmony of the tune;

second means for selectively generating an orchestration signal;

third means for receiving the orchestration signal and establishing a first orchestration attribute for the first part of harmony and a second orchestration attribute for the second part of harmony in response to the orchestration signal;

fourth means interfaced with the first means and third means for causing the tune to be played by simultaneously playing the first and second parts of harmony in accordance with the first and second orchestration attributes; and amen selector means for generating an amen signal in response to a user-generated command signal, wherein the computer receives the amen signal and causes the synthesizer means to play a plagal cadence at the end of the tune.

16. The music synthesizer device of claim 15, wherein the fourth means is a computer and the device further comprises synthesizer means electrically connected to the computer, wherein the computer generates a first control signal representative of the first part and a second control signal representative of the second part, and the synthesizer means receives the control signals and generates an audible signal in response.

17. The music synthesizer device of claim 16, wherein each note of the tune is represented by a corresponding note byte, and wherein a note byte can represent a musical tone or a rest and a corresponding time interval for holding the tone or rest.

18. The music synthesizer device of claim 17, further comprising at least one sound speaker and a portable housing for holding the sound speaker, computer, and synthesizer means.

19. The music synthesizer device of claim 18, further comprising a hand-held remote unit for holding the second means and for transmitting the orchestration signal to the computer.

20. The music synthesizer device of claim 19, further comprising at least one remote sound speaker electrically connected to the synthesizer means.

21. A method for playing at least one prestored tune having at least first and second simultaneously-played parts of harmony, comprising:

storing a first digital data series representative of the first part of harmony and a second digital data series representative of the second part of harmony;

selectively generating an orchestration signal;

receiving the orchestration signal and establishing a first orchestration attribute for the first part of harmony and a second orchestration attribute for the second part of harmony in response to the orchestration signal;

causing the first and second parts of harmony to be simultaneously played in response to the first and second digital data series and in accordance with the first and second orchestration attributes; and selectively generating a plagal cadence at the end of the tune.

* * * * *